US005768839A

United States Patent [19]

McCabe

[11] Patent Number: 5,768,839

[45] Date of Patent: Jun. 23, 1998

[54] CENTRAL FLANGE MOUNTED DAMPER

[76] Inventor: Francis J. McCabe, #6 Bunker Hill Rd., Ottsville, Pa. 18942

[21] Appl. No.: 625,796

[22] Filed: Mar. 29, 1996

[51] Int. Cl.[6] ..... F24F 13/10; F04G 21/02

[52] U.S. Cl. ..... 52/220.8; 52/741.3; 52/742.1; 454/369

[58] Field of Search ..... 52/232, 317, 220.8, 52/741.4, 741.41, 742.14, 656.2, 656.5, 656.6, 656.7, 741.3, 742.1; 169/48; 454/369, 257, 243, 357, 270, 271; 160/1; 236/49.2; 249/39

[56] References Cited

U.S. PATENT DOCUMENTS

| | | | |
|---|---|---|---|
| 3,214,873 | 11/1965 | Davis | 52/656.5 |
| 3,273,632 | 9/1966 | McCabe . | |
| 3,401,734 | 9/1968 | McCabe . | |
| 3,677,517 | 7/1972 | Root et al. | 454/369 |
| 3,727,663 | 4/1973 | McCabe . | |
| 3,768,223 | 10/1973 | Kurz | 52/658 |
| 3,830,146 | 8/1974 | Kaiser | 160/1 X |
| 3,834,577 | 9/1974 | Tempero | 52/220.8 X |
| 4,100,931 | 7/1978 | Pantland et al. | 160/1 X |
| 4,184,288 | 1/1980 | Magill et al. | 454/369 X |
| 4,430,831 | 2/1984 | Kemp | 249/39 |
| 4,524,678 | 6/1985 | Klebanoff | 454/369 |
| 4,579,047 | 4/1986 | Zielinski . | |
| 4,817,912 | 4/1989 | McCabe | 236/49.2 |
| 5,003,747 | 4/1991 | Morton | 52/656.5 |
| 5,067,676 | 11/1991 | Beele | 52/232 X |
| 5,171,184 | 12/1992 | Saucier et al. . | |
| 5,393,263 | 2/1995 | McCabe | 160/1 X |
| 5,555,682 | 9/1996 | Colitto | 52/656.7 |

FOREIGN PATENT DOCUMENTS

| | | | |
|---|---|---|---|
| 982901 | 2/1976 | Canada | 160/1 |
| 3539583 | 5/1987 | Germany | 454/369 |
| 655169 | 3/1986 | Switzerland | 52/1 |

*Primary Examiner*—Michael Safavi
*Attorney, Agent, or Firm*—Frank J. Benasutti

[57] ABSTRACT

A fire damper is provided with a central flange for mounting within a wall. The flange having a plurality of holes allowing any plaster material in the wall construction to pass through the holes and retain the damper. A miter cut is provided at the corners of the damper and the flange to allow for expansion during a fire. The damper is positioned within an opening in the wall with the flange positioned within the opening of the wall. The wall is built up by applying mortar against the damper and extending flange. With the mortar being forced through the holes in the flange to hold the damper in place.

3 Claims, 3 Drawing Sheets

CENTRAL FLANGE MOUNTED DAMPER

TECHNICAL FIELD

This invention relates to improvements in the means for mounting a fire damper in a wall, and in particular, to a means for mounting such a damper in a masonry or dry wall to provide a secure seal and retention during a fire.

BACKGROUND ART

Fire dampers, as shown, for example, in my U.S. Pat. Nos. 3,273,632 and 3,401,734, are commonly mounted in inner walls and partitions and the like in buildings and are connected to the air duct work. In the prior art, the ordinary means for accomplishing this mounting and positioning was to place a sleeve about the fire damper, attach the sleeve to the fire damper frame, position the sleeve in the wall so that an outwardly extending flange of the sleeve abutted one surface of the wall; then position a separate piece of angle iron against the opposite face of the wall, and then bolt the sleeve to the angle iron. It was then necessary to provide a separate adapter means to attach the sleeve to the air duct work. In my prior art U.S. Pat. No. 3,727,663, I describe and claim an adapter means improvement on this prior art. Therein, the prior art just described is shown by the angle iron 20 attached to the sleeve in the upper left hand corner of FIG. 1*a* of the drawings. In the '663 Patent, the device comprises one or more sheet metal members co-extensive with a portion of the fire damper which has been bent to engage the wall and the duct work.

There are other means of mounting fire dampers such as those employed in Europe in which the dampers are put in a channel which is anchored in the wall. The damper fits loosely in the channel inside another frame which is placed within the channel. During a fire, since metal expands faster than concrete, the channel tends to dislodge. Also, as underwriters' tests have shown, the damper first expands in one direction towards the fire and then could bow the other way as heat builds up with smoke control system pressure. This adds to its instability in its environment.

I have also noted that the fire underwriters' tests and actual fire conditions require that the fire damper be retained under the changing dynamic pressure conditions, so that it is not blown out of the wall. In other words, it is simply not enough to mount a damper, but the damper must be able to be retained within the wall during extreme pressure changing conditions. The present invention is directed to an apparatus and method for accomplishing that mounting in a simple and effective manner.

SUMMARY OF INVENTION

In accordance with the present invention, a central flange is welded to the frame of the damper and installed in various masonry brick or block wall constructions in a hole in the wall where it is mortared in place. The central flange has a plurality of holes designated, generally 19, in it so that the mortar passes through the holes during its installation and helps lock the damper in place. The damper also has a frame with a mitre cut in the corners which carries through the central flange of preferably 1/16th of an inch from the inner corner toward the outer corner, the outer corner being spot-welded. Accordingly, it is an object of this invention to eliminate the sub-inner frame construction while allowing for expansion of the damper under fire conditions to provide a secured fire damper.

DISCLOSURE OF THE INVENTION

DESCRIPTION OF THE PREFERRED EMBODIMENTS

Figure 1:
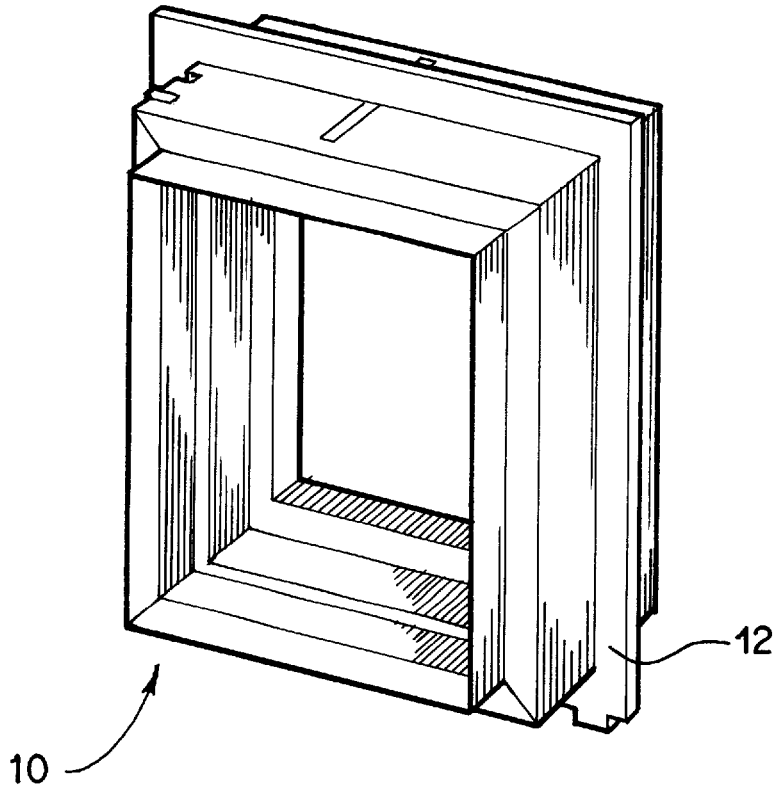
FIG. 1 shows a perspective view of a damper with a central flange in accordance with the preferred embodiment of my invention shown prior to its installation within a wall.
Figure 2A:
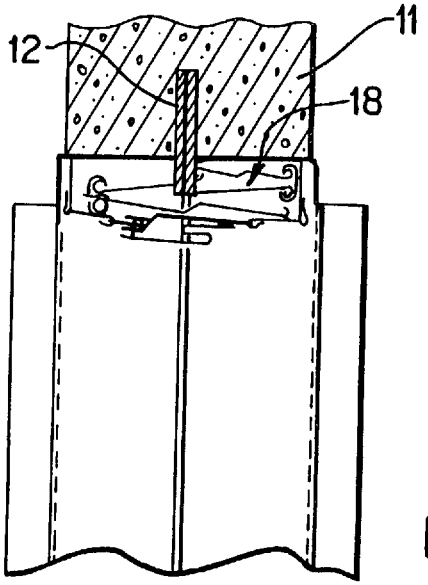
FIGS. 2*a* and 2*b* are cross-sections showing the damper of FIG. 1 in place in its useful environment partially broken away to show alternate environments.
Figure 2B:
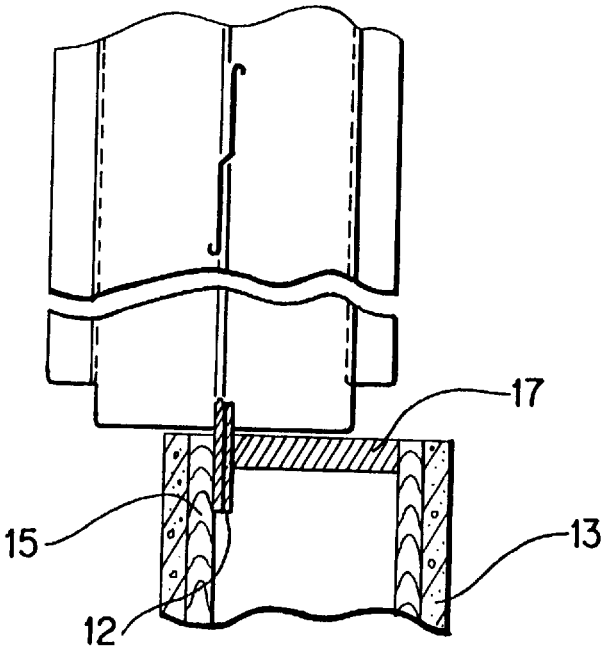

I have shown in FIG. 1 a fire damper, designated generally 10, in a perspective view before mounting in the wall of a building. The damper has a transversely extending central flange 12 in accordance with my invention to provide for mounting of the damper either in a masonry wall, as shown in FIG. 2*a* at 11, or a dry wall construction, as shown in FIG. 2*b* at 13. Insofar as masonry construction is concerned, the flange is particularly useful since it has a plurality of holes throughout along the web as shown in greater detail in FIG. 3. These holes allow for the mortar to pass through and harden to help retain the damper in the finished wall while being pliant during heat expansion as shown in FIG. 2*a*. The damper is placed in an enlarged hole in the masonry wall and then the masonry is applied to finish the wall against the surfaces of the damper. The central flange may typically be 18 gauge steel and is attached to the damper by welding the flange along the periphery of the damper, as shown, for example, at B and C in the details of FIG. 3. Typically, holes may be 5/8" in diameter and spaced an inch apart to two inches apart alternating along two different rows as clearly illustrated in FIG. 3.

Figure 3:
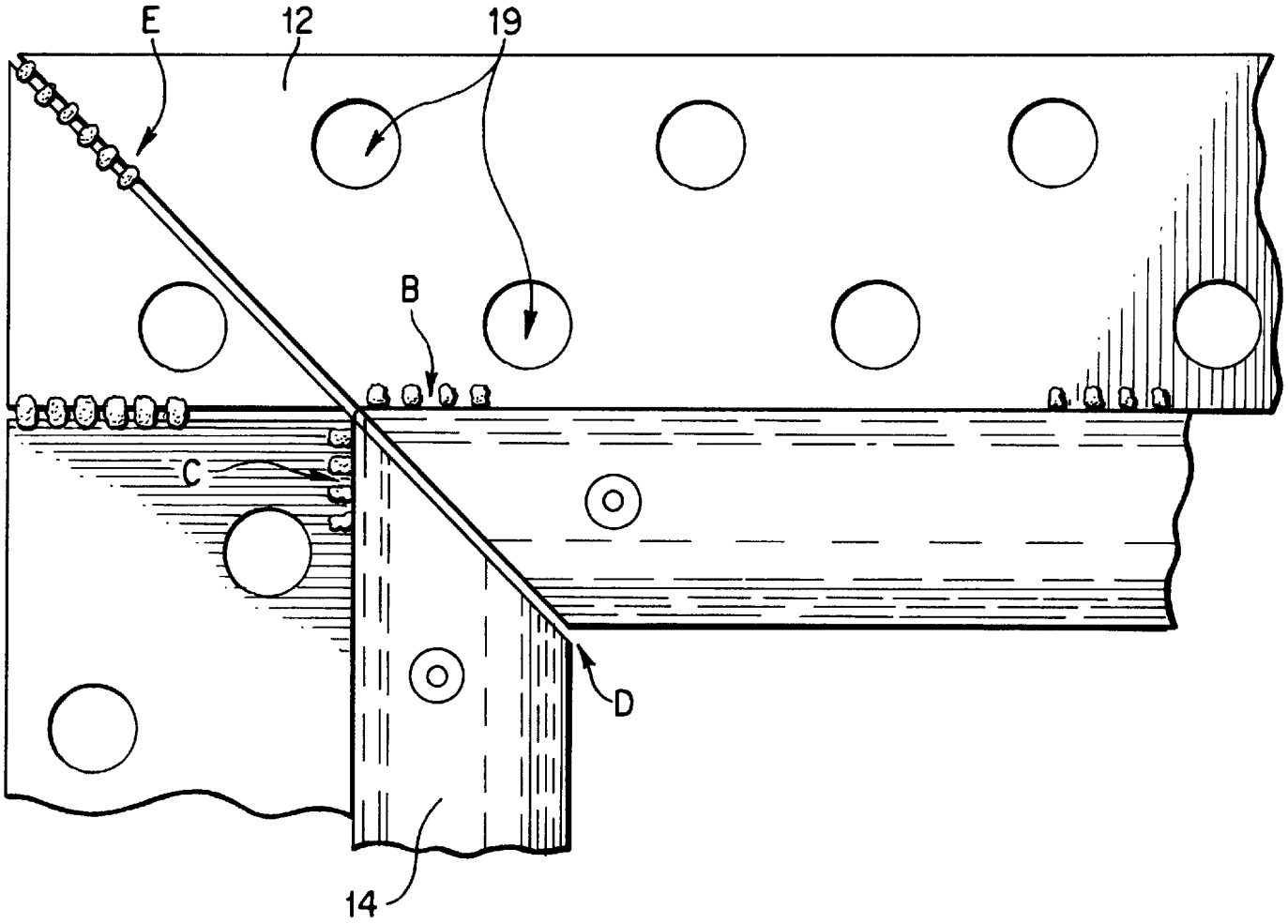
FIG. 3 is an enlarged plan view of a portion of my invention.

I found that the construction provides improved performance in actual fire conditions if the corners of the damper are mitred and cut to provide a 1/16" clearance per one linear meter of damper size. As shown, the mitre cut is from the internal corner D of the damper through the frame 14 and the flange 12 to the point E at which the flange is welded as shown in FIG. 3. Approximately one inch of weld would be provided on a flange web having a width of 2".

This type of mounting can also be useful in dry wall construction, although the advantages of having the masonry pass through the holes will not be obtained. Nevertheless, it is apparent that construction could facilitate rounting of the damper in a dry wall between studs 15 and braces 17 without the need for an additional sleeve as shown in FIG. 2*b*.

As noted above, in a typical fire situation, the prior art dampers would bow or be sucked out of the wall as the pressure builds during the fire. In actual tests, this construction actually tightens in place, making a better seal and more secure construction. It is theorized that the holes allow for expansion without ripping the damper out since metal expands faster than concrete. The 1/16" clearance allows the blades designated generally 18, FIG. 2*a*, which are expanding under the heat, to force outwardly against the sides of the damper which yields sufficiently so that they are not blown out.

METHOD OF OPERATION

To install the damper, a hole is first formed in the wall, be it masonry or dry wall, of a sufficient dimension to accept the damper with its centrally mounted, transversely outwardly extending flange. If it is a masonry constructed wall, the masonry is then built up to the sheet metal members which form the outer structure of the damper. The masonry may consist of additional block, bricks and mortar. Most preferably, the mortar is forced through the holes in the central flange so that when the mortar sets, it helps retain the damper in place.

In the dry wall construction, the damper can be placed such that the flange has supporting members on both sides; and, indeed, nails can be run through studs or cross-braces and into other braces which form the wall; the nails passing through the holes in the central flange.

I claim:

1. In a fire damper having an outer metal frame formed in a substantially rectangular channel shape terminating in ends whose edges lie in substantially parallel planes, the improvement comprising: a flange extending outwardly from said frame positioned about said outer metal frame in a plane substantially parallel to said planes in which said end edges lie; said flange located substantially centrally between said end edges and having a plurality of holes therethrough; said fire damper having a plurality of depending flanges extending inwardly from said end edges in said parallel planes of said end edges and forming with adjacent depending flanges, open mitred corners.

2. The invention of claim 1, wherein the centrally outwardly extending flange also has mitred corners which are partly open and partly permanently joined.

3. A method of mounting a fire damper in a masonry wall including mortar, said damper having a metal frame formed in a substantially rectangular channel shape terminating in end edges which lie in substantially parallel planes, comprising: providing said damper with a planar flange extending outwardly from and about said metal frame positioned in a plane substantially parallel to said planes of said end edges and located substantially centrally between the planes of said end edges; said flange having a plurality of holes therethrough; providing a hole in said wall; positioning the damper in said hole in said wall with the outwardly extending flange positioned within said hole and within said wall; and then building said wall up against the outer metal frame and outwardly extending flange, including forcing mortar through said holes in said flange.

* * * * *